US009024825B2

(12) United States Patent
Yang et al.

(10) Patent No.: US 9,024,825 B2
(45) Date of Patent: May 5, 2015

(54) MOBILE DEVICES WITH CONDUCTIVE LIQUID ANTENNAS AND RELATED METHODS

(71) Applicant: HTC Corporation, Taoyuan, Taoyuan County (TW)

(72) Inventors: Tae Young Yang, Cary, NC (US); William Haywood Tolbert, Chapel Hill, NC (US); Koichiro Takamizawa, Cary, NC (US)

(73) Assignee: HTC Corporation, Taoyuan, Taoyuan County (TW)

( * ) Notice: Subject to any disclaimer, the term of this patent is extended or adjusted under 35 U.S.C. 154(b) by 302 days.

(21) Appl. No.: 13/684,262

(22) Filed: Nov. 23, 2012

(65) Prior Publication Data

US 2014/0145899 A1 May 29, 2014

(51) Int. Cl.

| | |
|---|---|
| ***H01Q 1/24*** | (2006.01) |
| ***H01Q 3/24*** | (2006.01) |
| ***H01Q 1/36*** | (2006.01) |
| ***H01Q 3/01*** | (2006.01) |

(52) U.S. Cl.
CPC ..... *H01Q 3/24* (2013.01); *H01Q 1/243* (2013.01); *H01Q 1/364* (2013.01); *H01Q 3/01* (2013.01)

(58) Field of Classification Search
USPC ..... 343/860, 876, 702
See application file for complete search history.

(56) References Cited

U.S. PATENT DOCUMENTS

| | | | | |
|---|---|---|---|---|
| 6,211,830 | B1 * | 4/2001 | Monma et al. | 343/702 |
| 2013/0021217 | A1 * | 1/2013 | Tsai et al. | 343/807 |

* cited by examiner

*Primary Examiner* — Dieu H Duong
(74) *Attorney, Agent, or Firm* — McClure, Qualey & Rodack, LLP

(57) ABSTRACT

Mobile devices with conductive liquid antennas and related methods are provided. In this regard, a representative mobile device includes a first antenna having a first channel and a first liquid, the first channel defining a first interior volume, the first liquid being electrically conductive and located within the first channel, the first liquid further exhibiting a first volume smaller than the first interior volume; and a first antenna feed mounted such that, responsive to the device being in a first orientation, the first liquid electrically communicates with the first antenna feed.

20 Claims, 5 Drawing Sheets

MOBILE DEVICES WITH CONDUCTIVE LIQUID ANTENNAS AND RELATED METHODS

TECHNICAL FIELD

The present disclosure generally relates to mobile devices.

BACKGROUND

Near-field proximity effects from a human body may degrade the performance of a portable wireless device. In some cases, the wireless communication capability of a mobile device can be disabled due to energy absorption by the human body and/or because of severe frequency detuning. In an attempt to avoid these situations, much effort is involved with determining the antenna type, antenna feed, and antenna placement location that is used in a mobile device. Unfortunately, users tend to hold mobile devices differently. Thus, it is very challenging to find an optimal antenna solution in order to improve user experiences.

Reconfigurable, tunable and/or diversity antennas have been proposed as a potential solution to address this issue. However, these approaches typically involve the use of additional components including switches, variable capacitors, and/or diodes. These components also may involve the use of additional high-voltage bias signal lines that tend to increase the complexity of a circuit board. Further, an algorithm may be required in order to reconfigure the antenna structure and/or select the antenna. These solutions also may require one or more sensors to detect user behavior so that reconfiguring of the antenna with the algorithm may take place.

SUMMARY

Mobile devices with conductive liquid antennas and related methods are provided. Briefly described, one embodiment, among others, is a mobile device comprising: a first antenna having a first channel and a first liquid, the first channel defining a first interior volume, the first liquid being electrically conductive and located within the first channel, the first liquid further exhibiting a first volume smaller than the first interior volume; and a first antenna feed mounted such that, responsive to the device being in a first orientation, the first liquid electrically communicates with the first antenna feed.

Another embodiment is a method for reconfiguring a mobile device comprising: using gravity-induced flow of a conductive liquid to select an antenna of the mobile device.

Other systems, methods, features, and advantages of the present disclosure will be or may become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure may be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

FIGS. 2A and 2B are schematic diagrams of the embodiment of FIG. 1, in which FIG. 2A depicts the device in a first orientation, and FIG. 2B depicts the device in a second orientation.

DETAILED DESCRIPTION

Figure 1:
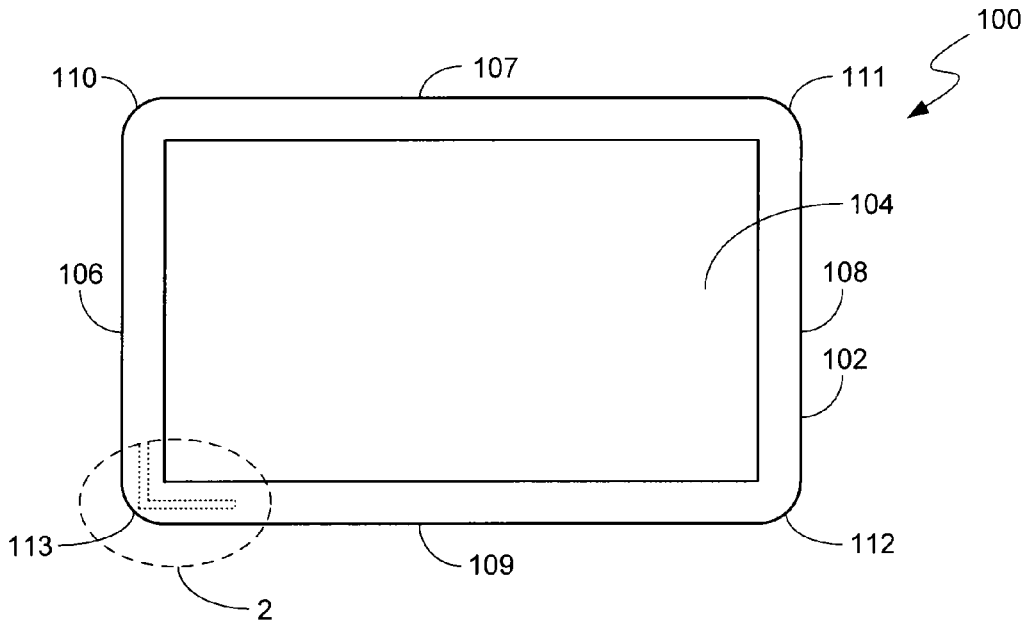
FIG. 1 is a schematic diagram of an example embodiment of a mobile device.

Having summarized various aspects of the present disclosure, reference will now be made in detail to that which is illustrated in the drawings. While the disclosure will be described in connection with these drawings, there is no intent to limit the scope of legal protection to the embodiment or embodiments disclosed herein. Rather, the intent is to cover all alternatives, modifications and equivalents included within the spirit and scope of the disclosure as defined by the appended claims.

In this regard, mobile devices with conductive liquid antennas and related methods are provided, in which gravity-induced flow of a conductive liquid is used to select an antenna of the mobile device. In some embodiments, the conductive liquid is contained within non-conductive channels that are configured to permit the liquid to flow therein. Antenna feeds are mounted to the channels so that, depending upon the orientation of the device, the liquid in at least one of the channels electrically communicates with its associated antenna feed(s). As such, additional components for determining orientation and/or user hand position (among possible other components) may not be required in order to provide for selective use from among multiple antennas.

FIG. 1 is a schematic diagram of an example embodiment of a mobile device (e.g., a tablet or smartphone). As shown in FIG. 1, device 100 includes a housing 102 and a display 104. In this embodiment, the housing includes peripheral side edges 106, 107, 108 and 109 and exterior corners 110, 111, 112 and 113. Of note, the mobile device is configured with wireless communication components (not shown) such as may be used to facilitate communication using one or more of various wireless communication protocols.

Figure 2A:
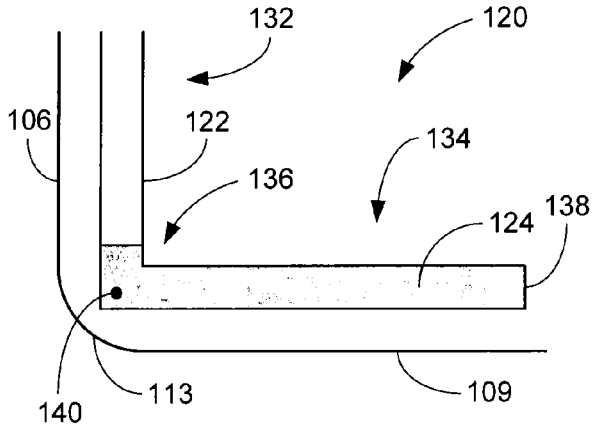
Figure 2B:
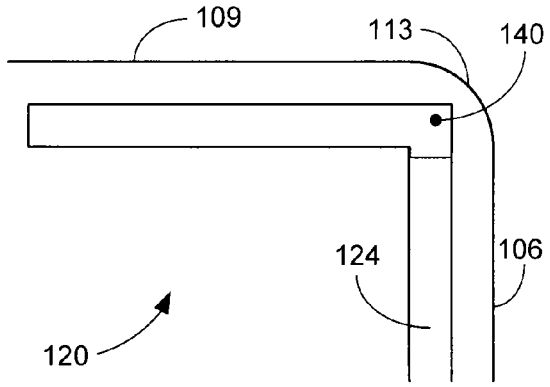

FIGS. 2A and 2B are schematic diagrams of the interior of the embodiment of FIG. 1, in which FIG. 2A depicts the device in a first orientation, and FIG. 2B depicts the device in a second orientation. As shown, mobile device 100 incorporates an antenna 120 that includes a channel 122 and a liquid 124. The liquid is electrically conductive and is hermetically sealed within the channel so that the liquid is able to flow within the channel in response to acceleration forces (e.g., gravity). To facilitate the flow of liquid, the interior volume of the channel is larger than the volume of the liquid.

Various conductive liquids may be used. By way of example, Mercury may exhibit suitable fluidic and conductive properties (although other considerations may make Mercury a poor choice). Additionally, Galistan (liquid Gallium with Indium and Tin), among possible others, may be used, with or without the inclusion of coatings on the interiors of the channels.

In this embodiment, the channel is configured with multiple segments, although various other configurations may be used in other embodiments. Specifically, the channel incorporates segments 132, 134, which extend outwardly from an interconnecting intermediate segment 136. Notably, segments 132 and 134 are spaced from and are oriented parallel to corresponding side edges of the housing.

Segment 134 (which is shown in its entirety) extends linearly from the intermediate segment to a distal end 138. Segment 134 also exhibits a uniform cross-sectional area (in this case, circular) along its length. In other embodiments, various other configurations may be used.

An antenna feed 140 is mounted to the intermediate segment, which is positioned adjacent to corner 113. So configured, the liquid may flow to a position in which the antenna feed and liquid electrically communicate with each other. In some embodiments, electrical communication may involve physical contact between the liquid and the antenna feed. For instance, in some embodiments, a portion of the antenna feed may protrude into the channel.

In the first orientation depicted in FIG. 2A, corner 113 of the device is positioned to be lower than corner 110 (FIG. 1) of the device. This is in contrast to that depicted in FIG. 2B, in which corner 113 is positioned higher than corner 110 (FIG. 1). Note that the orientation affects the disposition of the liquid within the channel.

As shown in FIG. 2A, when in the first orientation, liquid 124 flows to occupy segment 134 and intermediate segment 136 to an extent that the liquid electrically communicates with antenna feed 126. When moved to the second orientation (FIG. 2B), the liquid flows into segment 132, thereby discontinuing electrical communication between the liquid and the antenna feed. When both antennas are activated for other possible embodiments (e.g., those in which additional antenna feeds are located in between the corners), either selection diversity or embedded diversity functions in mobile communication standards may take advantage of processing system gain.

Figure 3:
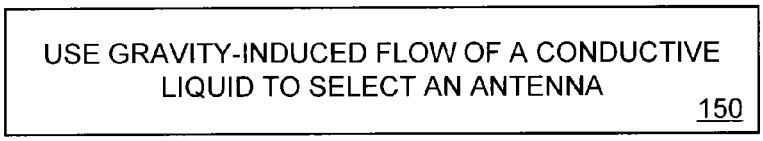
FIG. 3 is a schematic diagram of another example embodiment of a mobile device.

In this regard, FIG. 3 is a flowchart depicting an example embodiment of a method for reconfiguring a mobile device. As shown in FIG. 3, the method involves using gravity-induced flow of a conductive liquid to select an antenna of the mobile device (block 150). In some embodiments, the mobile device includes multiple antennas, with the antennas being configured for operation based the orientation of the mobile device.

Figure 4:
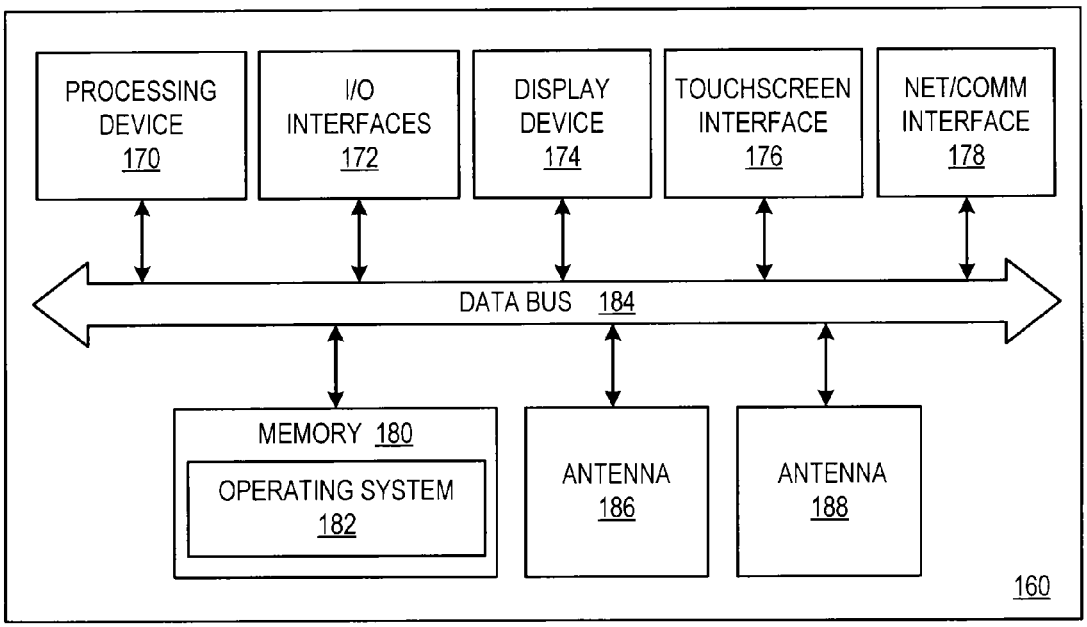
FIG. 4 is a flowchart depicting an example embodiment of a method.

FIG. 4 is a schematic diagram of another example embodiment of a mobile device. As shown in FIG. 3, mobile device 160 includes a processing device (processor) 170, input/output interfaces 172, a display device 174, a touchscreen interface 176, a network/communication interface 178, a memory 180, and an operating system 182, with each communicating across a local data bus 184. Additionally, the system incorporates antennas 186 and 188.

The processing device 170 may include a custom made or commercially available processor, a central processing unit (CPU) or an auxiliary processor among several processors, a semiconductor based microprocessor (in the form of a microchip), one or more application specific integrated circuits (ASICs), a plurality of suitably configured digital logic gates, and other electrical configurations comprising discrete elements both individually and in various combinations to coordinate the overall operation of the system.

The memory 180 may include any or a combination of volatile memory elements (e.g., random-access memory (RAM, such as DRAM, and SRAM, etc.)) and nonvolatile memory elements. The memory typically comprises native operating system 182, one or more native applications, emulation systems, or emulated applications for any of a variety of operating systems and/or emulated hardware platforms, emulated operating systems, etc. For example, the applications may include application specific software which may comprise some or all the components of the system. In accordance with such embodiments, the components are stored in memory and executed by the processing device.

Touchscreen interface 176 is configured to detect contact within the display area of the display 174 and provides such functionality as on-screen buttons, menus, keyboards, soft keys, etc. that allows users to navigate user interfaces by touch.

One of ordinary skill in the art will appreciate that the memory may, and typically will, comprise other components which have been omitted for purposes of brevity. Note that in the context of this disclosure, a non-transitory computer-readable medium stores one or more programs for use by or in connection with an instruction execution system, apparatus, or device.

With further reference to FIG. 4, network/communication interface 178 may comprise various components used to transmit and/or receive data over a networked environment. By way of example, such components may include a wireless communications interface. When such components are embodied as an application, the one or more components may be stored on a non-transitory computer-readable medium and executed by the processing device.

Antennas 186 and 188 selectively (and, in this case, alternately) electrically interconnect with the network/communication interface to transmit and/or receive data. In particular, each of the antennas incorporates a channel that encapsulates a conductive liquid. In operation, the liquid flows within the respective channels responsive to movement and/or orientation of the device so that one of the antennas is functioning at any given time.

Figure 5:
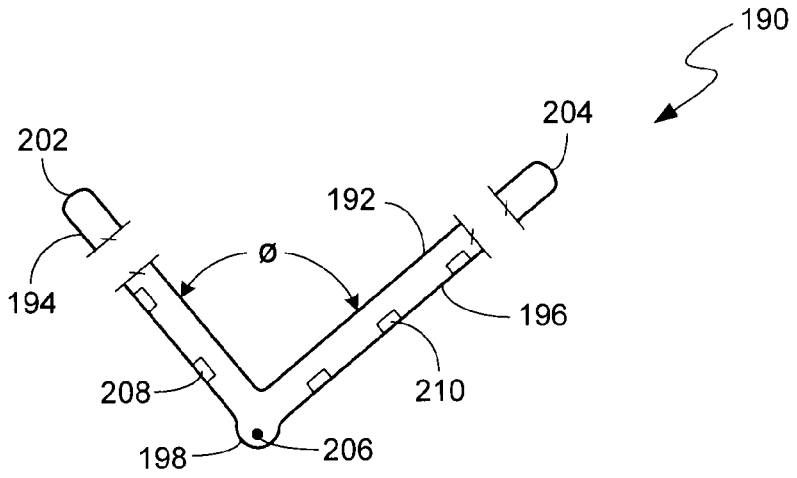
FIG. 5 is a schematic diagram of an example embodiment of an antenna.

An example embodiment of an antenna that may be used in a mobile device is depicted schematically in FIG. 5. In the embodiment of FIG. 5, antenna 190 includes a channel 192 that is hermetically sealed to contain a conductive liquid (not shown). Channel 192 is configured with elongate segments 194, 196, each of which extends outwardly from interconnecting intermediate segment 198 to a respective distal end 202, 204. In this embodiment, the distal ends of the channel are curved.

Segments 194 and 196 define an included angle (ø) which, in this embodiment, is approximately 90 degrees. In some other embodiments, it is not necessary for the included angle to be 90 degrees to make sure at least one of the antennas is activated.

An antenna feed 206 is mounted to the intermediate segment, which is configured as a rather bulbous outward extending portion of the channel. Notably, the bulbous portion protrudes from the portion of the channel opposite the included angle.

Impedance-matching components (e.g., components 208, 210) are distributed along the segments to assist in correcting for dynamic changes in the effective length and/or shape of the antenna attributable to various user behaviors while using a mobile device. In particular, the impedance-matching components of this embodiment are located on the outboard portions of the segments and help to tune the antenna to desired operational frequencies. Notably, the number of impedance-matching components active at any given time is associated with the positioning of the liquid within the channel, as electrical communication with the liquid effectively activates a component. Thus, as the orientation of the antenna changes, the number of activated components changes.

In some embodiments, an impedance-matching component may include a conductive material, which may be provided in various configurations (e.g., a wire). The shape of the conductive material may be similar to the shape of the cross-sectional shape of the channel, such as may be achieved by the material conforming to a surface of the channel. An example of such an embodiment is depicted schematically in FIG. 6.

Figure 6:
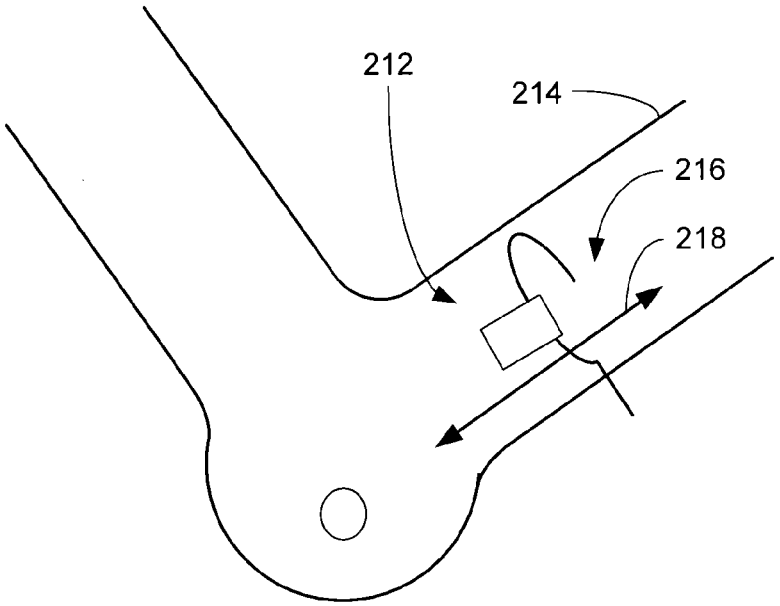
FIG. 6 is a schematic diagram of an example embodiment of an antenna showing detail of an impedance-matching component.

As shown in FIG. 6, an impedance-matching component 212 is positioned within a channel 214. Component 212 incorporates a conductive material, which is pattered to include an open end 216 that may be shorted to signal ground (Gamma impedance or shunt matching) and/or connected to another impedance-matching component (not shown) by conductive liquid (represented by double-ended arrow 218). Thus, as the liquid level in the channel rises and falls, continuity and discontinuity with the component is correspondingly achieved. The other end of the conductive material may be configured in a similar way, i.e., shorted to signal ground and/or connected to another impedance-matching component as an impedance-matching network.

Figure 7A:
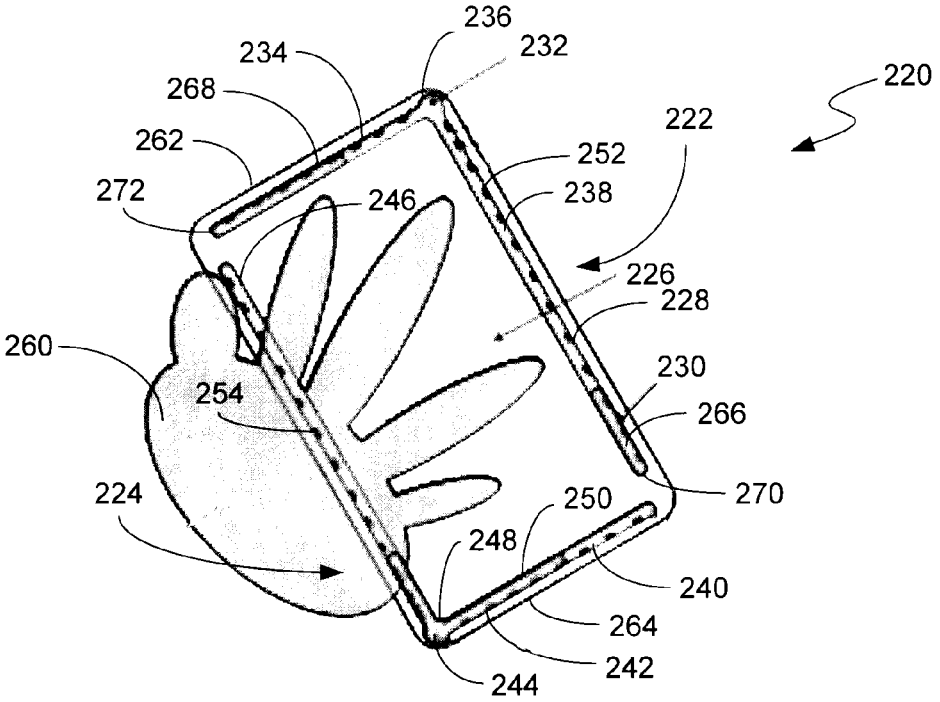
FIGS. 7A-7D are schematic diagrams of another example embodiment of a mobile device, in which each depicts the device in a different orientation.

An example of an embodiment of a mobile device that incorporates multiple antennas is depicted schematically in FIGS. 7A-7D, in which each depicts the device in a different orientation. In particular, FIG. 7A shows device 220 incorporating antennas 222 and 224, which are located within a housing 226. Antenna 222 includes a channel 228, liquid 230 and an antenna feed 232, with the channel being formed of segments 234, 236 and 238. Antenna 224 includes a channel 240, liquid 242 and an antenna feed 244, with channel 240 being formed of segments 246, 248 and 250. Also included are multiple impedance-matching components (e.g., components 252, 254) that are distributed along the channels.

In the orientation depicted in FIG. 7A, in which a user is grasping the mobile device with a hand 260, an edge 262 of the device is positioned higher than an edge 264 such that intermediate segment 236 among the segments is positioned at a highest point of the device. In this example, this orientation results in liquid 230 separating into two slugs (266, 268), with slug 266 being located in a vicinity of distal end 270, and slug 268 being located in a vicinity of distal end 272. As such, liquid 230 is not in electrical communication with antenna feed 232. Thus, antenna 222 is not the selected antenna.

In contrast, the orientation of the device in FIG. 7A results in liquid 242 remaining in a single slug that is in electrical communication with antenna feed 244. Thus, antenna 224 is the selected antenna for device operation. Notably, the flow of liquid within the channels results in the antenna with the lowest positioned antenna feed becoming the active antenna. In this example, the lowest antenna is naturally positioned away from the user's hand.

In order to cover 360 degree use of the mobile device, the short-length side channel may be filled with just enough conductive liquid to activate the device. If 360 degree use is not necessary depending on an user's typical behavior and/or particular system form-factor, for example, the amount of liquid and the detail shape of the channel may be modified such as to accommodate the user's behavior.

Figure 7B:
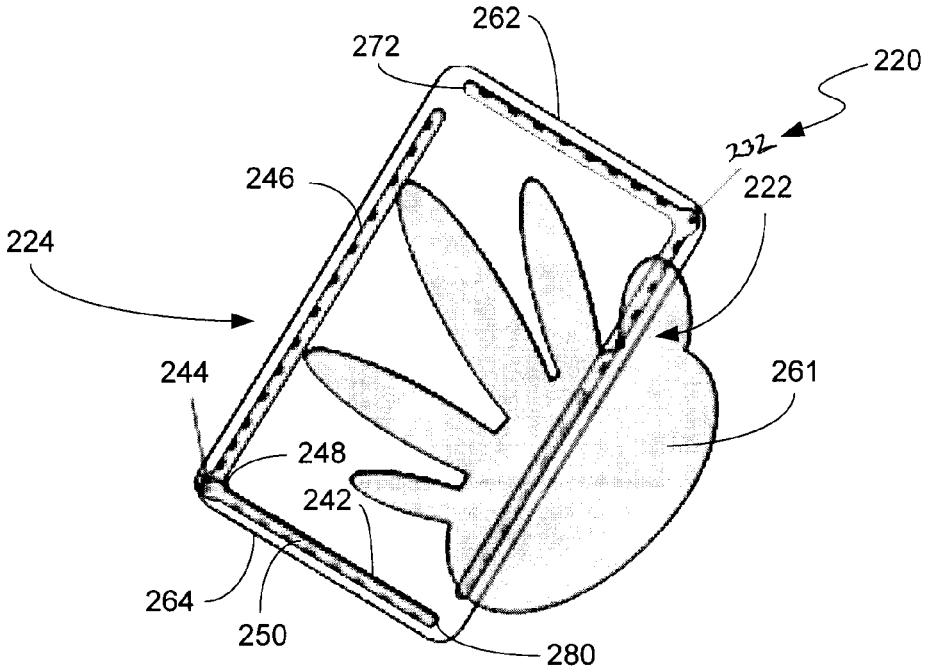

In the orientation depicted in FIG. 7B, the user is grasping the mobile device with hand 261 with edge 262 once again being positioned higher than edge 264. However, distal end 272 is now positioned at a highest point of the device. In this example, this orientation results in liquid 230 flowing away from antenna feed 232 such that the liquid is not in electrical communication with the antenna feed. Once again, antenna 224 is not the selected antenna. Specifically, liquid 242 remains in electrical communication with antenna feed 244. Thus, antenna 224 is the selected antenna for device operation. Notably, the amount of liquid 242 within channel 240 is large enough to facilitate electrical communication with antenna feed 244 if the liquid remains in a single slug that extends upwardly from distal end 280 of segment 250 unless the orientation of segment 250 approaches close enough to vertical (e.g., within approximately 5 degrees).

Figure 7C:
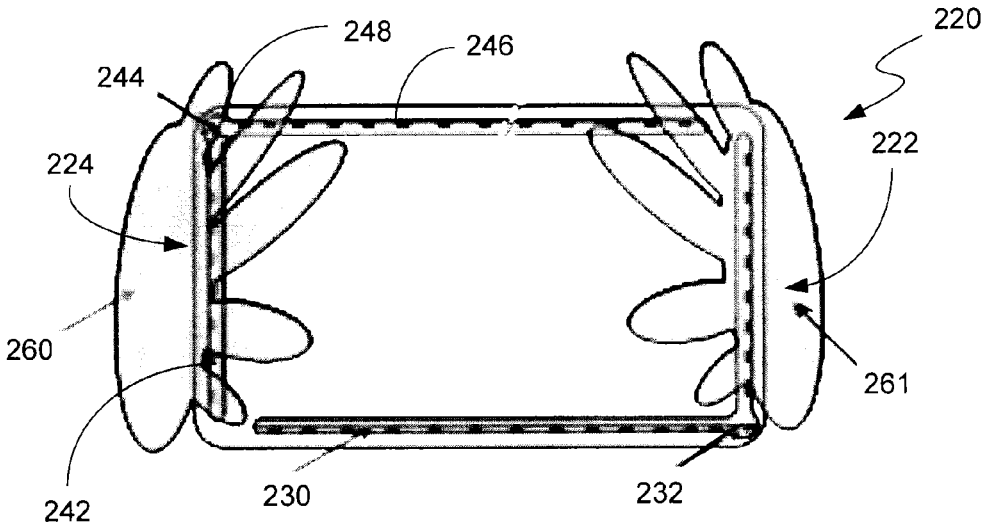

The vertical orientation of segment 250 (which corresponds to a horizontal position of the device) is depicted in FIG. 7C, in which electrical communication between antenna feed 244 and liquid 242 is discontinued. In particular, enough of liquid 242 flows into one or more of segments 246 and 248 to break electrical continuity. However, this orientation permits liquid 230 to flow into contact with antenna feed 232. Therefore, antenna 222 becomes the active antenna.

Figure 7D:
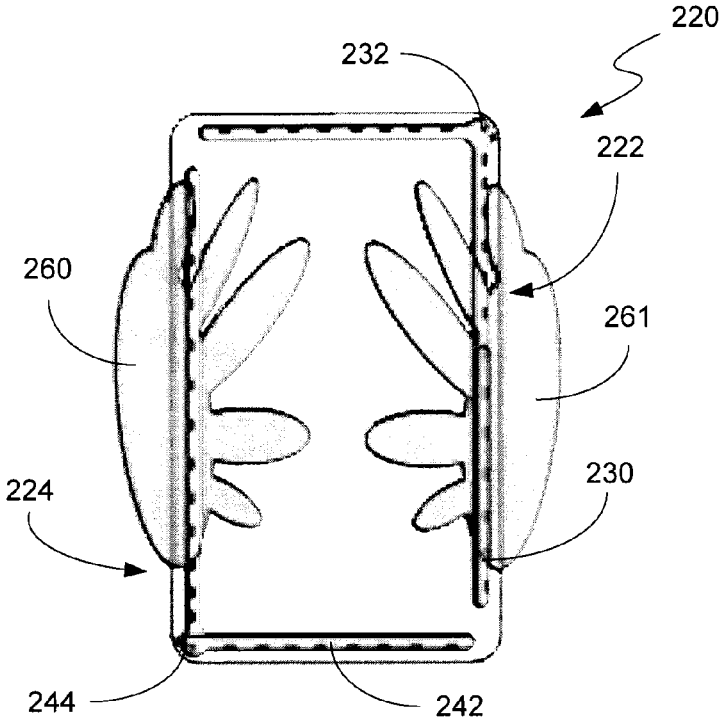

In FIG. 7D, it is shown that antenna 222 becomes inactive and antenna 224 becomes active when in the device is moved to the vertical position.

It should be emphasized that the above-described embodiments are merely examples of possible implementations. Many variations and modifications may be made to the above-described embodiments without departing from the principles of the present disclosure. By way of example, the systems described may be implemented in hardware, software or combinations thereof. All such modifications and variations are intended to be included herein within the scope of this disclosure and protected by the following claims.

At least the following is claimed:

1. A mobile device comprising:

a first antenna having a first channel and a first liquid, the first channel defining a first interior volume, the first liquid being electrically conductive and located within the first channel, the first liquid further exhibiting a first volume smaller than the first interior volume;

a first antenna feed mounted such that, responsive to the device being in a first orientation, the first liquid electrically communicates with the first antenna feed;

a second antenna having a second channel and a second liquid, the second channel defining a second interior volume, the second liquid being electrically conductive and located within the second channel, the second liquid further exhibiting a second volume smaller than the second interior volume; and a second antenna feed mounted such that, responsive to the device being in a second orientation, the second liquid electrically communicates with the second antenna feed and electrical communication between the first liquid and the first antenna feed is discontinued.

2. The device of claim 1, wherein, in the first orientation, electrical communication between the second liquid and the second antenna feed is discontinued.

3. The device of claim 2, wherein:

the first feed and the second feed are positioned in respective corners; and the device further comprises at least one feed in between the first and second feeds to activate more than one antenna in the first orientation or the second orientation.

4. The device of claim 1, wherein the first channel and the second channel are electrically non-conductive.

5. A mobile device comprising:

a first antenna having a first channel and a first liquid, the first channel defining a first interior volume, the first liquid being electrically conductive and located within the first channel, the first liquid further exhibiting a first volume smaller than the first interior volume; and a first antenna feed mounted such that, responsive to the device being in a first orientation, the first liquid electrically communicates with the first antenna feed;

wherein:

the first channel has a first segment, a second segment and an intermediate segment interconnecting the first segment and the second segment; and the first antenna feed is mounted to the intermediate segment.

6. The device of claim 5, further comprising:

a second antenna having a second channel and a second liquid, the second channel defining a second interior volume, the second liquid being electrically conductive and located within the second channel, the second liquid further exhibiting a second volume smaller than the second interior volume; and a second antenna feed mounted such that, responsive to the device being in a second orientation, the second liquid electrically communicates with the second antenna feed and electrical communication between the first liquid and the first antenna feed is discontinued.

7. The device of claim 5, wherein the intermediate segment exhibits a larger cross-sectional area than respective cross-sectional areas exhibited by the first segment and the second segment.

8. The device of claim 5, wherein the first segment has a distal end and extends linearly from the intermediate segment to the distal end.

9. The device of claim 5, wherein the first segment has a uniform cross-sectional area along a length thereof.

10. The device of claim 5, wherein:

the device has a housing with peripheral side edges; and each of the segments is parallel with a corresponding one of the side edges.

11. The device of claim 5, wherein:

the housing has an exterior corner; and the intermediate segment is located adjacent the corner.

12. The device of claim 5, wherein the first segment is shorter than the second segment.

13. The device of claim 5, wherein the first segment exhibits a smaller interior volume than that of the second segment.

14. A mobile device comprising:

a first antenna having a first channel and a first liquid, the first channel defining a first interior volume, the first liquid being electrically conductive and located within the first channel, the first liquid further exhibiting a first volume smaller than the first interior volume; and a first antenna feed mounted such that, responsive to the device being in a first orientation, the first liquid electrically communicates with the first antenna feed;

wherein:

the device further comprises a first impedance-matching component operative to alter an impedance of the first antenna;

the first impedance-matching component being oriented such that, in the first orientation, the first liquid electrically communicates with the first impedance-matching component and, in the second orientation, the first liquid does not electrically communicate with the first impedance-matching component.

15. The device of claim 1, further comprising impedance-matching means selectively electrically communicating with the first liquid to selectively alter an impedance of the first antenna.

16. The device of claim 1, wherein the device is configured as a smartphone.

17. The device of claim 14, wherein the first channel has a first segment, a second segment and an intermediate segment interconnecting the first segment and the second segment.

18. The device of claim 17, wherein the first segment exhibits a smaller interior volume than that of the second segment.

19. The device of claim 17, wherein the first antenna feed is mounted to the intermediate segment.

20. The device of claim 17, wherein the intermediate segment exhibits a larger cross-sectional area than respective cross-sectional areas exhibited by the first segment and the second segment.

* * * * *